US006692117B1

(12) United States Patent
Kamp

(10) Patent No.: US 6,692,117 B1
(45) Date of Patent: Feb. 17, 2004

(54) LIQUID CONTAINMENT AND DISPENSING DEVICE WITH IMPROVED FLOW CONTROL VALVE

(75) Inventor: David C. Kamp, Grand Rapids, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 1104 days.

(21) Appl. No.: 08/891,884

(22) Filed: Jul. 14, 1997

(51) Int. Cl.[7] ..... B41J 2/175
(52) U.S. Cl. ..... 347/86
(58) Field of Search ..... 347/84, 85, 86, 347/87; 401/40

(56) References Cited

U.S. PATENT DOCUMENTS

| | | | | | |
|---|---|---|---|---|---|
| 3,720,473 | A | * | 3/1973 | Nakata | 401/40 |
| 5,040,002 | A | | 8/1991 | Pollacek et al. | 347/87 |
| 5,523,780 | A | * | 6/1996 | Hirosawa et al. | 347/86 |
| 5,734,401 | A | * | 3/1998 | Clark et al. | 347/86 |

FOREIGN PATENT DOCUMENTS

| | | | |
|---|---|---|---|
| EP | 0 052 914 | A1 | 2/1982 |
| EP | 58084772 | | 5/1983 |
| EP | 0 160 463 | A2 | 4/1985 |
| EP | 0 498 117 | A2 | 5/1991 |
| EP | 0 562 717 | A1 | 9/1993 |
| EP | 0 709 207 | A2 | 10/1995 |
| EP | 0 760 288 | A1 | 1/1996 |
| EP | 0 741 038 | A2 | 11/1996 |
| EP | 19637879 | A1 | 5/1997 |
| EP | 98 11 2871.3 | | 8/1999 |
| GB | 2 264 997 | A | 9/1993 |
| JP | SHO60-23047 | | 2/1985 |
| JP | SHO61-37933 | | 3/1986 |
| JP | SHO61-256072 | | 11/1986 |
| JP | HEI9-105472 | | 4/1997 |

* cited by examiner

*Primary Examiner*—Anh T. N. Vo

(57) ABSTRACT

An ink containment and dispensing device for an ink-jet printer is provided with a main reservoir in the form of a flexible pouch, which is typically maintained at ambient pressure. The main reservoir is coupled to a variable volume chamber via a one-way valve which allows the flow of ink from the reservoir to the chamber and prevents the flow of ink from the chamber to the reservoir. The chamber is coupled to a fluid outlet, which is normally closed to prevent the flow of outward ink. However, when the ink supply is installed in a printer, the fluid outlet establishes a fluid connection between the chamber and the printer. The chamber is part of a pump provided with the ink supply that can be actuated to supply ink from the reservoir to the printer. The pump has a linearly acting pumping member and a flexible diaphragm that overlies the pumping member, the diaphragm being impervious to the transmission of oxygen and moisture therethrough to prevent degradation of the ink within the chamber.

10 Claims, 7 Drawing Sheets

FIG. 11
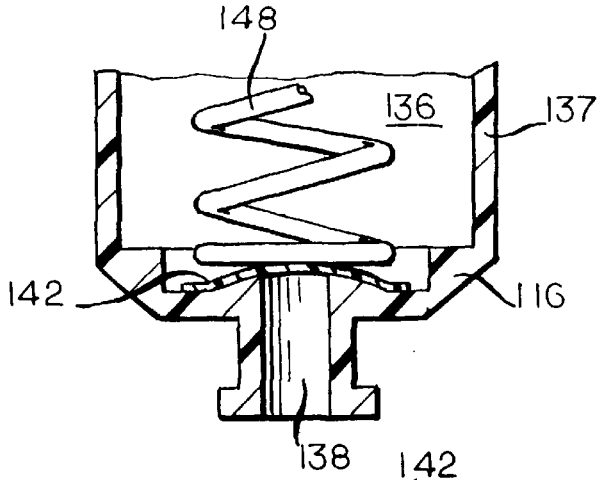
FIG. 10
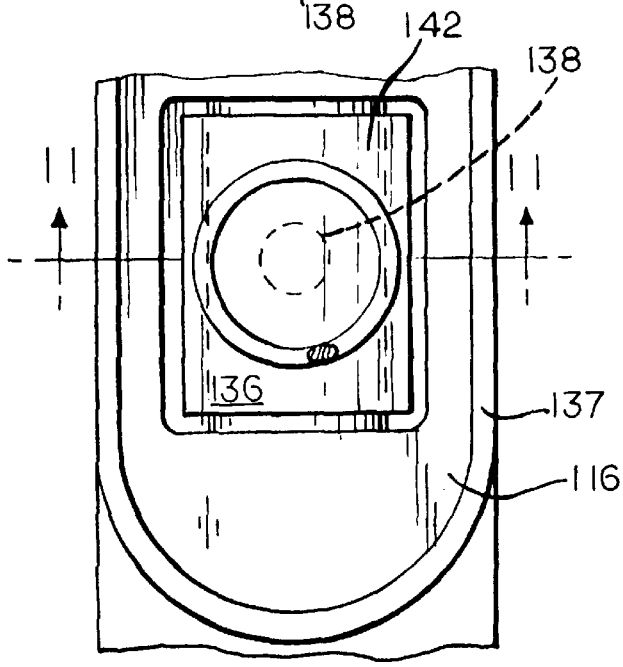
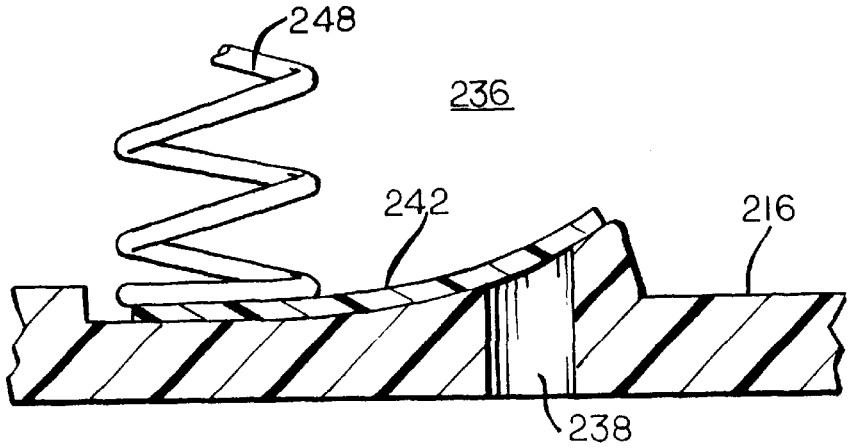
FIG. 12

FIG. 13
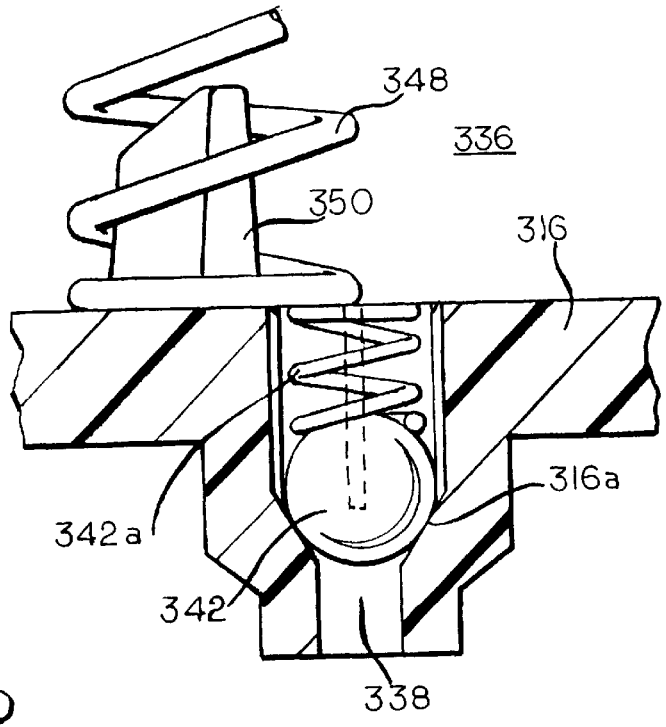
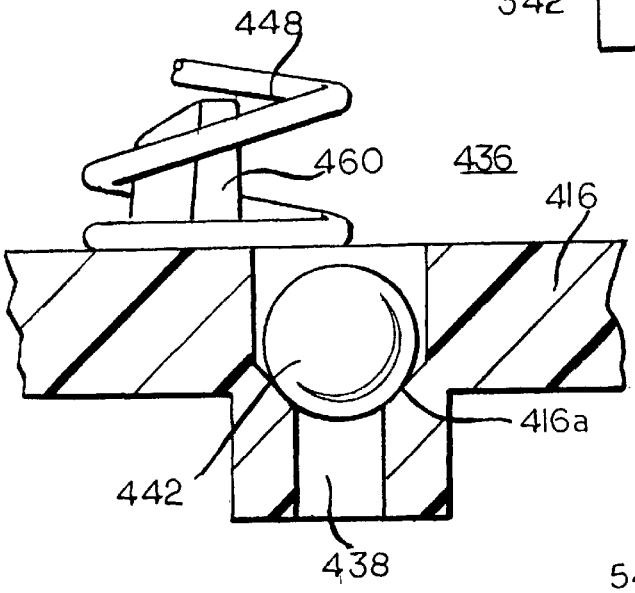
FIG. 14
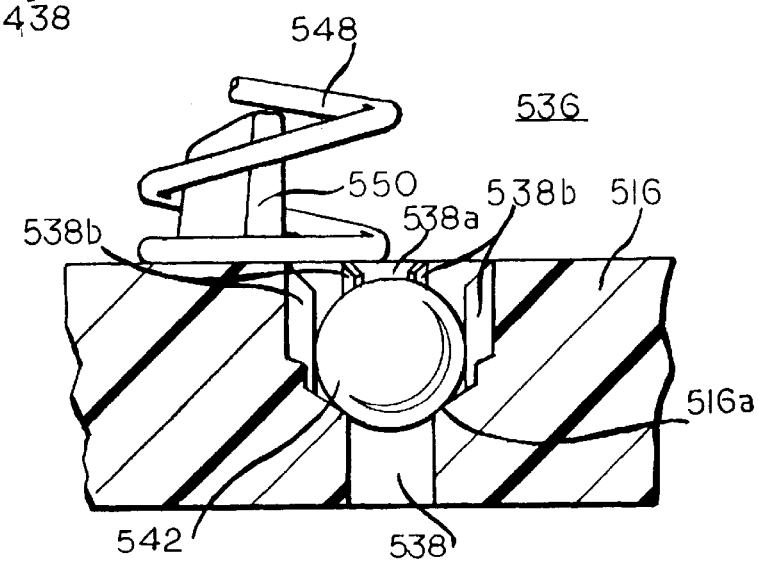
FIG. 15

LIQUID CONTAINMENT AND DISPENSING DEVICE WITH IMPROVED FLOW CONTROL VALVE

CROSS-REFERENCE TO RELATED APPLICATION

This application is directed to improvements in the invention disclosed in U.S. patent application Ser. No. 08/429,987, now U.S. Pat. No. 5,784,087 an application in which I am named as a joint inventor.

FIELD OF THE INVENTION

This invention relates to a liquid containment device with a self-contained pump for dispensing liquid in small doses of a predetermined volume. More particularly, this invention relates to a replaceable containment device of the foregoing character which is useful in an ink-jet printer for containing a supply of printing ink and for dispensing the printing ink to a printing head upon the actuation of the self-contained pump.

BACKGROUND AND BRIEF DESCRIPTION OF THE INVENTION

A pending U.S. patent application filed by Bruce Cowger and Norman Pawlowski, Jr., for an invention entitled "Ink Supply For An Ink-Jet Printer," describes an ink supply for an ink-jet printer that is separate from the printer ink pen, and can be replaced upon the emptying of the ink supply without the need to replace the printer ink pen. The ink supply of the aforesaid U.S. patent application incorporates a self-contained pumping device for dispensing ink from a pumping chamber, and describes, as an embodiment of such a pumping device, a bellows pump. However, a bellows pump requires a relatively large extended surface of a semi-rigid material, such as a polymeric material, and is subject to a relatively high rate of oxygen and moisture transfer through the material of the bellows. This oxygen and/or moisture transfer can result in the degradation of the ink within the ink supply, especially in a printer that is used only infrequently. Further, the bellows is subject to leakage at the location of its attachment to another portion of the ink supply. According to the aforesaid pending U.S. patent application Ser. No. 08/429,987, these and other problems associated with the use of a bellows can be avoided by the use of a pumping device having a rigid perimetrical wall, preferably formed integrally with the associated chassis structure of the ink supply, with a linearly acting pumping member that is moveable within a pumping chamber defined by the rigid wall to pressurize ink within the pumping chamber, and a flexible moisture and oxygen barrier film heat sealed to an edge of the perimetrical wall in a continuous pattern and overlying the pumping member.

An ink supply according to the aforesaid U.S. patent application Ser. No. 08/429,987 incorporates a check valve in the form of a thin, flexible flapper valve heat staked to the chassis to prevent the return of ink from the pumping chamber to the pouch upon the pressurization of the ink during a dispensing cycle. However, the heating of the flapper valve needed to heat stake the flapper valve to the chassis can result in permanent distortion of the flapper valve, with a resultant loss in effectiveness of its flow retarding qualities during ink dispensing cycles. It has now been found, however, in accordance with certain embodiments of the present invention that a suitable check valve in the form of a flapper valve can be provided without the need to heat stake the flapper valve to the chassis by providing a spring to urge the flapper valve against the chassis, either in the form of a spring that is aligned with the opening in the chassis that is to be closed by the flapper valve or a spring that is offset with respect to such opening. It has also been found, in accordance with an alternative embodiment of the present invention, that a suitable check valve can be provided in the form of a spring biased or free-floating check ball that selectively seats against a fixed seat to block the return of ink from the pumping chamber to the pouch during a pumping cycle while permitting ink flow from the pouch into the pumping chamber at the conclusion of a pumping cycle.

Accordingly, it is an object of the present invention to provide an improved liquid containing and dispensing device. It is also a corollary object of the present invention to provide an improved device of the foregoing character that is useful in containing and dispensing ink in an ink-jet printer.

More particularly, it is an object of the present invention to provide a liquid containment and dispensing device with an improved check valve to prevent the return of liquid from a pumping element of the device to a liquid containing pouch during a pumping cycle and it is a corollary object of the present invention to provide a device of the foregoing character that is useful in containing and dispensing ink in an ink-jet printer.

For a further understanding of the present invention and the objects thereof, attention is directed to the drawing and the following brief description thereof, to the detailed description of the preferred embodiment of the invention, and to the appended claims.

BRIEF DESCRIPTION OF THE DRAWING

FIG. 10 is a fragmentary plan view of an alternative embodiment of a portion of the liquid containment and dispensing device of FIGS. 1–9;

FIG. 11 is a fragmentary sectional view taken on line 11—11 of FIG. 10;

FIG. 12 is a fragmentary elevational view, partly in section, of another alternative embodiment of a portion of the liquid containment and dispensing device of FIGS. 1–9; and FIGS. 13–18 are views similar to FIG. 12 of additional alternative embodiments of the present invention.

DETAILED DESCRIPTION OF THE PREFERRED EMBODIMENT

Figure 1:
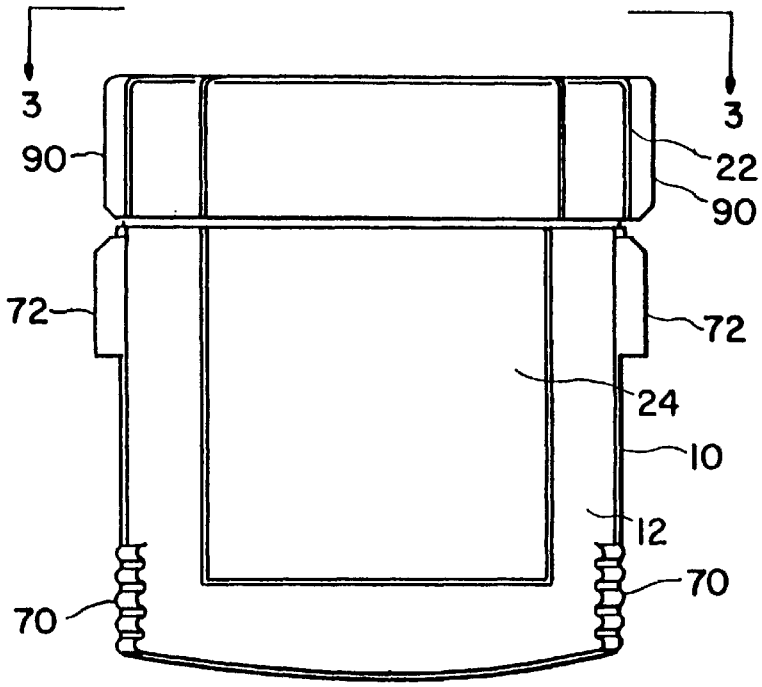
FIG. 1 is a side view of a liquid containment and dispensing device according to an embodiment of the present invention.
Figure 2:
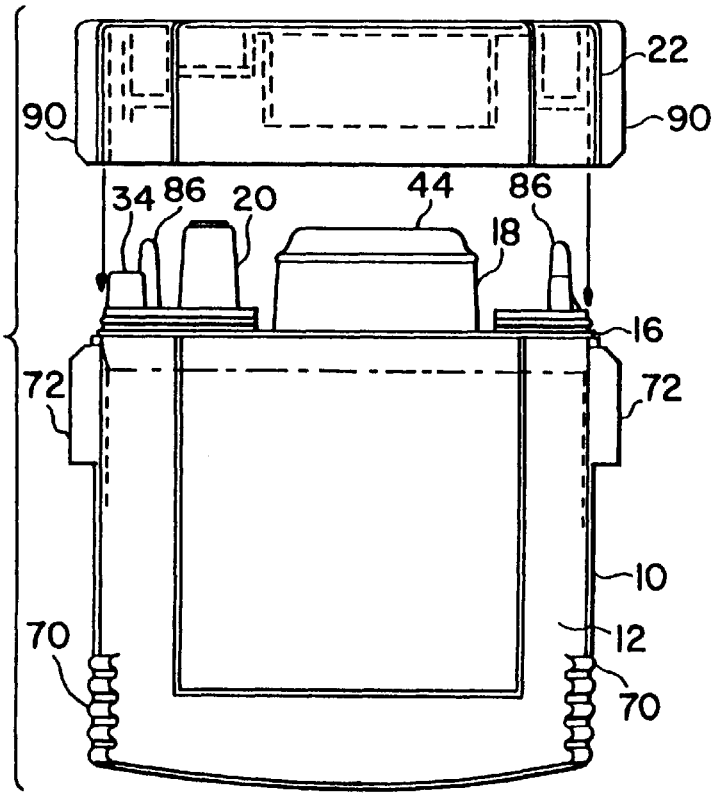
FIG. 2 is a an exploded view of the device of FIG. 1.
Figure 3:
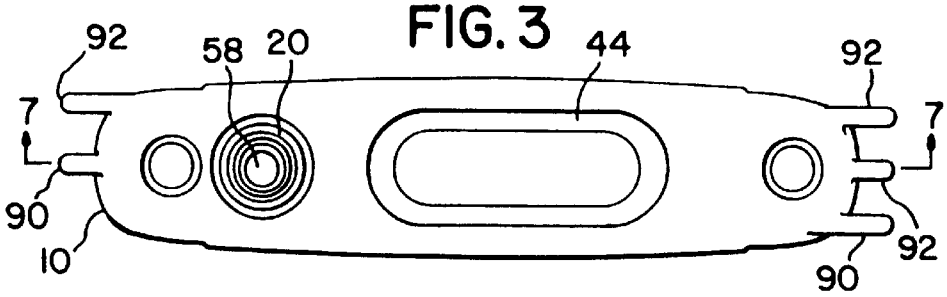
FIG. 3 is a plan view of the device of FIGS. 1 and 2 taken on line 3—3 of FIG. 1.
Figure 4:
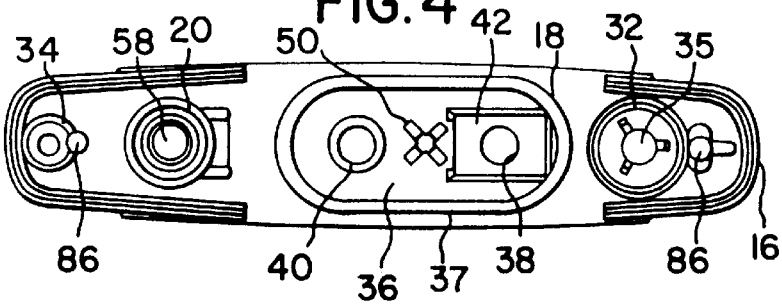
FIG. 4 is a plan view of a component of the device of FIGS. 1–3 taken on line 4—4 of FIG. 5.
Figure 5:
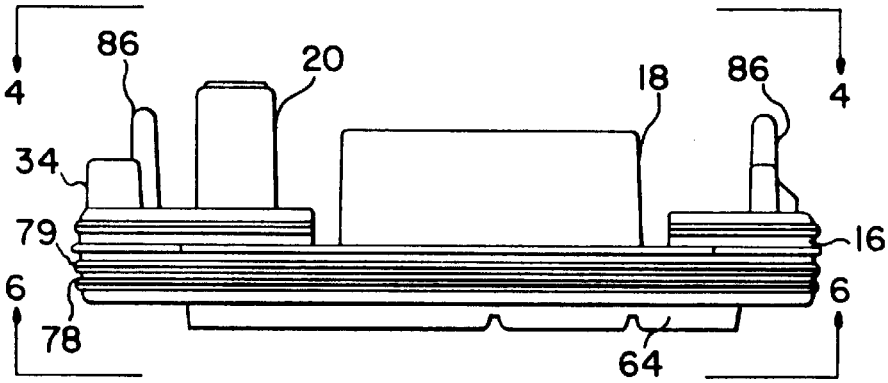
FIG. 5 is a side view of the component of FIG. 4.
Figure 6:
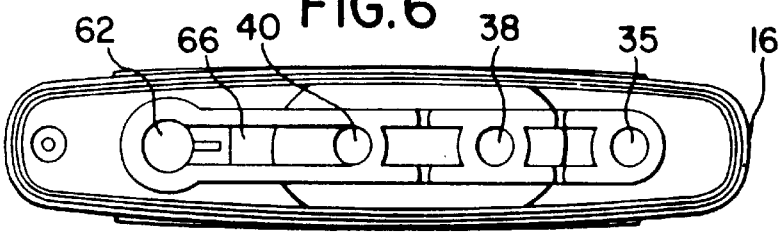
FIG. 6 is a plan view of the component of FIGS. 4 and 5 taken on line 6—6 of FIG. 5.
Figure 7:
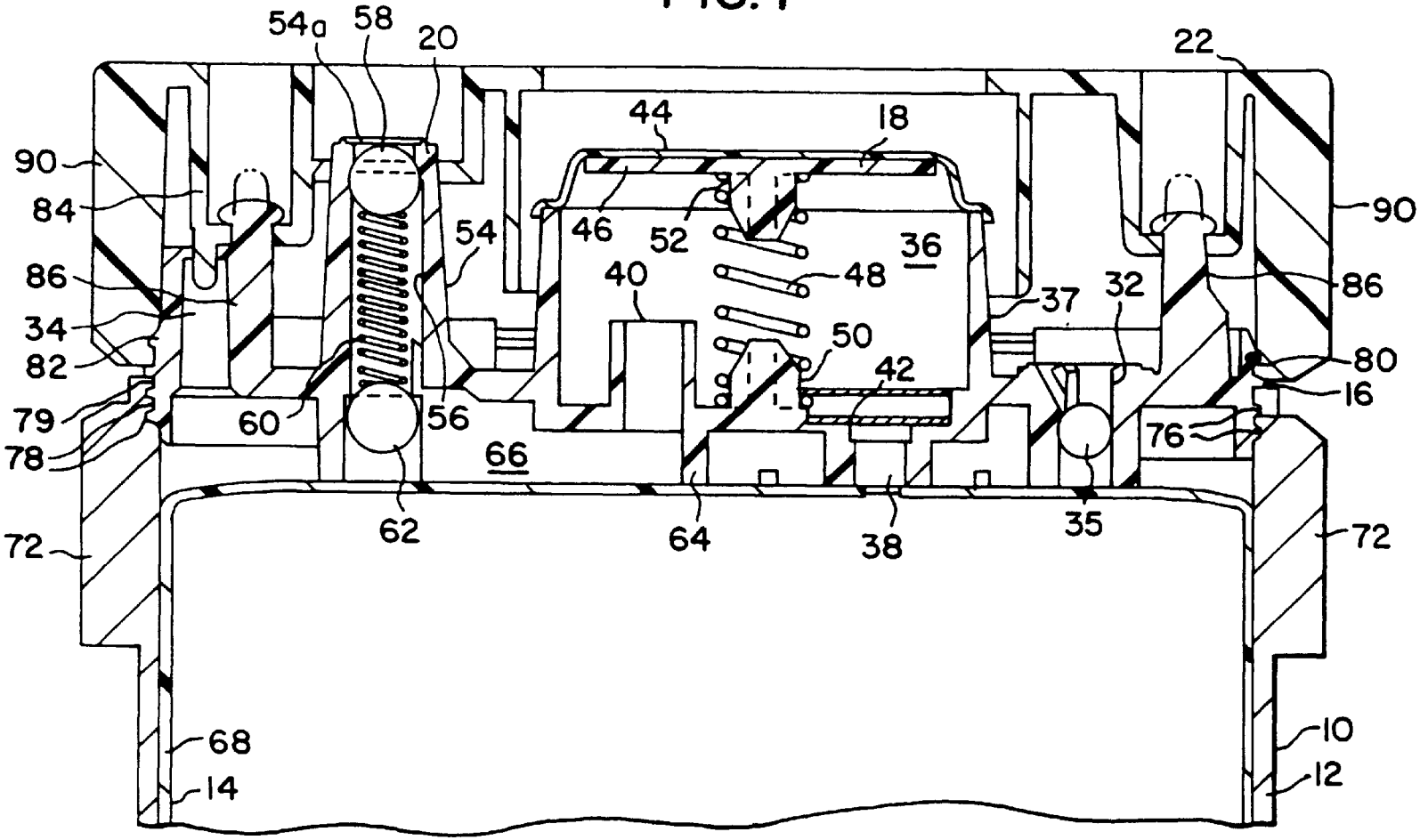
FIG. 7 is a fragmentary sectional view taken on line 7—7 of FIG. 3 and at an enlarged scale.
Figure 8:
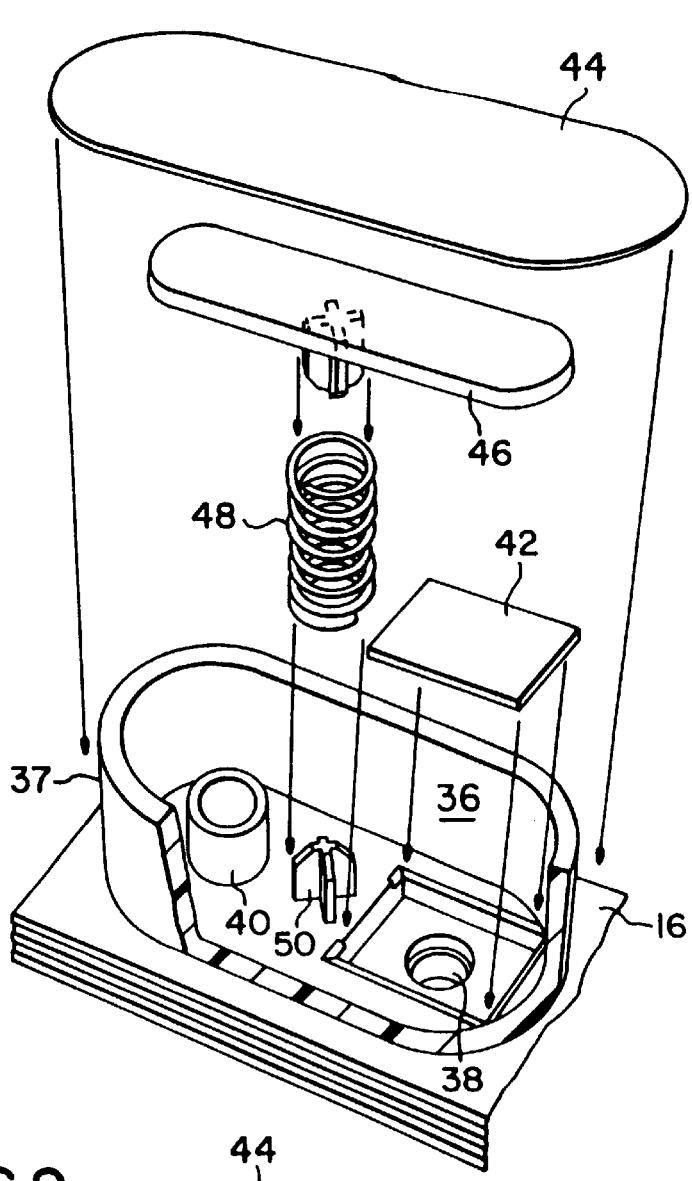
FIG. 8 is a fragmentary exploded view of a portion of the device of FIGS. 1–7.
Figure 9:
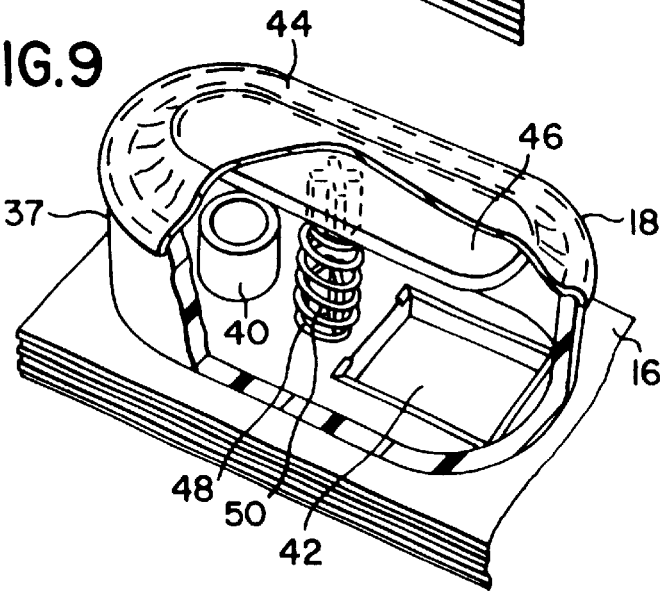
FIG. 9 is a fragmentary view similar to FIG. 8 showing the elements of FIG. 8 in assembled relationship to one another.

An ink containment and dispensing device in accordance with the embodiment of the invention described in the aforesaid U.S. patent application Ser. No. 08/429,987 is identified in FIG. 1 by reference numeral 10. The device 10 has a hard protective shell 12 which contains a flexible pouch 14 for containing ink. The shell 12 is attached to a chassis 16, which houses a pump 18 and a fluid outlet 20. A protective cap 22 is attached to the chassis 16 and a label 24 is glued to the outside of the shell 12 and cap 22 elements of the device 10 to secure the shell 12, chassis 16, and cap 22 firmly together. The cap 22 is provided with apertures which allow access to the pump and the fluid outlet.

The device 10 is adapted to be removably inserted into a docking bay (not shown) within an ink-jet printer. When the device 10 is inserted into the printer, a fluid inlet in the docking bay is adapted to engage the fluid outlet 20 to allow ink flow from the device 10 to the printer. An actuator (not shown) in the docking bay is adapted to engage the pump 18. Operation of the actuator causes the pump 18 to provide ink in a series of small doses of a predetermined volume from the flexible pouch 14, through the fluid outlet 20, to the fluid inlet of the docking bay and then to the printer.

The chassis 16 is provided with a fill port 32 at one end and an exhaust port 34 at the other end. Ink can be added to the ink supply through the fill port 32 while air displaced by the added ink is exhausted through the exhaust port 34. After the ink supply is filled, the fill port 32 is sealed with a ball 35 press fit into the fill port 32.

A pumping chamber 36 having an open bottom is formed on the bottom of the chassis 16 within a rigid perimetrical wall 37, which is preferably formed integrally with the chassis 16. As described in more detail below, the chamber 36 can be pressured to supply ink to the printer without pressurizing the interior of the pouch 14. The top of the chamber 36 is provided with an inlet port 38 through which ink may enter the chamber 36 from the pouch 14 by gravity and/or by a negative pressure within the chamber 36. An outlet port 40 through which ink may be expelled from the chamber 36 is also provided.

A one-way flapper valve 42 located at the bottom of the inlet port 38 serves to limit the return of ink from the chamber 36 to the pouch 14. The flapper valve 42 is a rectangular piece of flexible material. In the illustrated embodiment the valve 42 is positioned over the bottom of the inlet port 38 and is heat staked to the chassis 16 at the midpoints of its short sides. When the pressure within the chamber 36 drops below that in the pouch 14, the unstaked sides of the valve 42 each flex to allow the flow of ink through the inlet port 38 and into the chamber 36. By heat staking the valve 42 to the chassis 16 along an opposed pair of sides, less flexing of the valve 42 is required or permitted than would be the case if the valve 42 were staked only along a single side, thereby ensuring that it closes more securely, and this effect is enhanced by doing the heat staking at the midpoints of the shorter sides, as opposed to the longer sides.

In the illustrated embodiment the flapper valve 42 is made of a two ply material. The outer ply is a layer of low density polyethylene 0.0015 inches thick. The inner ply is a layer of polyethylene terephthalate (PET) 0.0005 inches thick. The illustrated flapper valve 42 is approximately 5.5 millimeters wide and 8.7 millimeters long. Such a material is impervious to the flow of ink therethrough when the valve 42 is in its closed position.

The bottom of the chamber 36 is covered with a flexible diaphragm 44. The diaphragm 44 is slightly larger than the opening at the bottom of the chamber and is sealed around the free edge of the perimetrical wall 37 that defines the chamber 36. The excess material in the oversized diaphragm 44 allows the diaphragm to flex up and down to vary the volume of the chamber 36. In the illustrated device, the displacement of the diaphragm 44 allows the volume of the chamber 36 to be varied by about 0.7 cubic centimeters. The fully expanded volume of the illustrated chamber 36 is between about 2.2 and 2.5 cubic centimeters.

In the illustrated embodiment, the diaphragm 44 is made of a multi-ply material having a layer of low density polyethylene 0.0005 inches thick, a layer of adhesive, a layer of metallized polyethylene terephthalate (PET) 0.00048 inches thick, a layer of adhesive, and a layer of low density polyethylene 0.0005 inches thick. Of course, other suitable materials may also be used to form the diaphragm 44. The diaphragm 44 in the illustrated embodiment is heat staked, using conventional methods, to the free edge of the wall 37 of the chamber 36. During the heat staking process, the low density polyethylene in the diaphragm will seal any folds or wrinkles in the diaphragm 44. The diaphragm 44, thus, is impervious to the transmission of oxygen and moisture therethrough, thereby safeguarding the ink in the chamber 36 from degradation by exposure to any such substance.

Within the chamber 36 a pressure plate 46 is positioned adjacent the diaphragm 44, the pressure plate 46 serving as a piston with respect to the chamber 36. A pump spring 48, made of stainless steel in the illustrated embodiment, biases the pressure plate 46 against the diaphragm 44 to urge the diaphragm outward so as to expand the size of the chamber 36. One end of the pump spring 48 is received on a spike 50 formed on the top of the chamber 36 and the other end of the pump spring 48 is received on a spike 52 formed on the pressure plate 46 in order to retain the pump spring 48 in position. The pressure plate 46 in the illustrated embodiment is molded of high density polyethylene.

A hollow cylindrical boss 54 extends downward from the chassis 16 to form the housing of the fluid outlet 20, the boss 54 being formed integrally with the chassis 16. A bore 56 of the hollow boss 54 has a narrow throat **54*a* at its lower end. A sealing ball 58, made of stainless steel in the illustrated embodiment, is positioned within the bore 56. The sealing ball 58 is sized such that it can move freely within the bore 56, but cannot pass through the narrow throat portion 54*a* thereof. A sealing spring 60 is positioned within the bore 56 to urge the sealing ball 58 against the narrow throat 54*a* to form a seal and prevent the flow of ink through the fluid outlet. A retaining ball 62, made of stainless steel in the illustrated embodiment, is press fit into the top of the bore to retain the sealing spring 60 in place. The bore 56 is configured to allow the free flow of ink past the retaining ball 62 and into the bore 56**.

A raised manifold 64 is formed on the top of the chassis 16. The manifold 64 forms a cylindrical boss around the top of the fill port 32 and a similar boss around the top of the inlet port 38 so that each of these ports is isolated. The manifold 64 extends around the base of the fluid outlet 20 and the outlet port 40 to form an open-topped conduit 66 joining the two outlets.

The flexible ink pouch 14 is attached to the top of the manifold 64 so as to form a top cover for the conduit 66. In the illustrated embodiment, this is accomplished by heat staking a rectangular plastic sheet 68 to the top surface of the manifold 64 to enclose the conduit 66. In the illustrated embodiment, the chassis 16 molded of high density polyethylene and the plastic sheet is low density polyethylene that is 0.002 inches thick. These two materials can be easily heat staked to one another using conventional methods and are also readily recyclable.

After the plastic sheet 68 is attached to the chassis 16, the sheet is folded and sealed around its two sides and top to form the flexible ink pouch 14. Again, in the illustrated embodiment, heat staking can be used to seal the perimeter of the flexible pouch 14. The plastic sheet over the fill port 32 and over the inlet port 38 can be punctured, pierced, or otherwise removed so as not to block the flow of ink through these ports.

Although the flexible pouch 14 provides an ideal way to contain ink, it may be easily punctured or ruptured and allows a relatively high amount of water loss from the ink. Accordingly, to protect the pouch 14 and to limit water loss, the pouch 14 is enclosed within a protective shell 12. In the illustrated embodiment, the shell 12 is made of clarified polypropylene, which is sufficiently translucent to permit inspection of the ink within the pouch 14 to determine that an adequate volume of ink remains for proper operation of the printer. A thickness of about one millimeter has been found to provide robust protection and to prevent unacceptable water loss from the ink. However, the material and thickness of the shell may vary in other embodiments.

The top of the shell 12 has a number of raised ribs 70 to facilitate gripping of the shell 12 as it is inserted in or withdrawn from the docking bay. A vertical rib 72 projects laterally from each side of the shell 12. The vertical rib 72 can be received within a slot (not shown) in the docking bay to provide lateral support and stability to the ink supply when it is positioned within the printer. The bottom of the shell 12 is provided with two circumferential grooves or recesses 76 which engage two circumferential ribs or beads 78 formed on a depending perimetrical wall 79 of the chassis 16 to attach the shell 12 to the chassis 16 in a snap fit.

The attachment between the shell 12 and the chassis 16 should, preferably, be snug enough to prevent accidental separation of the chassis from the shell and to resist the flow of ink from the shell should the flexible reservoir develop a leak. However, it is also desirable that the attachment not form a hermetic seal to allow the slow ingress of air into the shell as ink is depleted from the reservoir 14 to maintain the pressure inside the shell generally the same as the ambient pressure. Otherwise, a negative pressure may develop inside the shell and inhibit the flow of ink from the reservoir. The ingress of air should be limited, however, in order to maintain a high humidity within the shell and minimize water loss from the ink.

In the illustrated embodiment, the shell 12 and the flexible pouch 14 which it contains have the capacity to hold approximately thirty cubic centimeters of ink. The shell is approximately 67 millimeters wide, 15 millimeters thick, and 60 millimeters high. The flexible pouch 14 is sized so as to fill the shell without undue excess material. Of course, other dimensions and shapes can also be used depending on the particular needs of a given printer.

To fill the device 10, ink can be injected through the fill port 32. As it is filled, the flexible pouch 14 expands so as to substantially fill the shell 12. As ink is being introduced into the pouch, the sealing ball 58 can be depressed to open the fluid outlet and a partial vacuum can be applied to the fluid outlet 20. The partial vacuum at the fluid outlet causes ink from the pouch 14 to fill the chamber 36, the conduit 66, and the bore 56 of the cylindrical boss 54 such that little, if any, air remains in contact with the ink. The partial vacuum applied to the fluid outlet 20 also speeds the filling process. To further facilitate the rapid filling of the pouch 14, an exhaust port 34 is provided to allow the escape of air from the shell as the reservoir expands. Once the ink supply is filled, a ball 35 is press fit into the fill port 32 to prevent the escape of ink or the entry of air.

Of course, there are a variety of other ways which can also be used to fill the present ink containment and dispensing device. In some instances, it may be desirable to flush the entire device with carbon dioxide prior to filling it with ink. In this way, any gas trapped within the device during the filling process will be carbon dioxide, not air. This may be preferable because carbon dioxide may dissolve in some inks while air may not. In general, it is preferable to remove as much gas from the device as possible so that bubbles and the like do not enter the print head or the trailing tube.

The protective cap 22 is placed on the device 10 after the reservoir is filled. The protective cap is provided with a groove 80 which receives a rib 82 on the chassis to attach the cap to the chassis. The cap carries a lug 84 which plugs the exhaust port 34 to limit the flow of air into the chassis and reduce water loss from the ink. A stud 86 extends from each end of the chassis 16 and is received within an aperture in the cap 22 to aid in aligning the cap and to strengthen the union between the cap and the chassis. The free ends of the studs 86, which extend beyond the apertures of the cap 22, are preferably deformed after the cap 22 is in place, for example, by contacting them with a heated tool, to provide a tamper resistant attachment of the cap 22 to the chassis 16. Further, the label 24 is glued to the sides of the device 10 to hold the shell 12, chassis 16, and cap 22 firmly together. In the illustrated embodiment, a hot-melt pressure sensitive or other adhesive is used to adhere the label in a manner that prevents the label from being peeled off and inhibits tampering with the ink supply.

The cap 22 in the illustrated embodiment is provided with a vertical rib 90 protruding from each side. The rib 90 is an extension of the vertical rib 72 on the shell and is received within the slot provided in the docking bay in a manner similar to the vertical rib 72. In addition to the rib 90, the cap 22 has protruding keys 92 located on each side of the rib 90. One or more of the keys 92 can be optionally deleted or altered so as to provide a unique identification of the particular ink supply by color or type. Mating keys (not shown), identifying a particular type or color of ink supply can be formed in the docking bay. In this manner, a user cannot inadvertently insert an ink supply of the wrong type or color into a docking bay. This arrangement is particularly advantageous for a multi-color printer where there are adjacent docking bays for ink supplies of various colors.

In the embodiment of FIGS. 10–11, elements that correspond to the elements of the embodiment of FIGS. 1–9 are identified by a 100 series numeral, the last two digits of which correspond to the two digits of the corresponding element of the embodiment of FIGS. 1–9.

The flapper valve of the embodiment of FIGS. 10–11 is identified by reference numeral 142. The flapper valve 142, which is formed of a thin flexible sheet or lamination, serves to permit the flow of ink through an inlet port 138 in a molded plastic chassis 116 into a pumping chamber 136 that is defined by the perimetrical wall 137. The flow of ink through the inlet port 138 into the pumping chamber 136 occurs when the pressure in the pumping chamber 136 is less than the pressure in the inlet port 138. In that regard, the flapper valve 142 is not heat staked to the adjacent structure of a chassis 116, it being resiliently biased thereagainst by a pump spring 148. The opposed end of the pump spring 148, not shown, engages a pressure plate, also not shown, that corresponds in construction and function to the pressure plate 46 of the embodiment of FIGS. 1–9. In any case, when the pressure in the pumping chamber 136 is less than the pressure in the inlet port 138, the flapper valve 142 will unseat from the adjacent structure of the chassis 116, which will permit ink to flow through the inlet port 138 into the pumping chamber 136, by gravity and/or by pressure. When the pressure in the pumping chamber 136 is greater than the pressure in the inlet port 138, however, which will be the case during a pumping cycle of an ink-jet containment and dispensing device that incorporates the flapper valve 142, the pump spring 148 will expand to securely bias the flapper valve 142 against the opening of the inlet port 138 into the pumping chamber 136, thereby blocking the reverse flow of ink from the pumping chamber 136 into the inlet port 138. As is clear from FIGS. 10–11 of the drawing, the pump spring 148 is axially aligned with the inlet port 138.

In the embodiment of FIG. 12, elements that correspond to the elements of the embodiment of FIGS. 1–9 are identified by a 200 series numeral, the last two digits of which correspond to the corresponding element of the embodiment of FIGS. 1–9.

The flapper valve of the embodiment of FIG. 12 is identified by reference numeral 242. The flapper valve 242, which is formed of a thin flexible sheet or lamination, serves to permit the flow of ink through an inlet port 238 in a molded plastic chassis 216 into a pumping chamber 236 that is defined by a perimetrical wall, not shown, which corresponds to the perimetrical wall 37 of the embodiment of FIGS. 1–9, when the pressure in the pumping chamber 236 is less than the pressure in the inlet port 238. In that regard, the flapper valve 242 is not heat staked to the adjacent structure of a chassis 216, it being resiliently biased thereagainst by a pump spring 248. The opposed end of the pump spring 248, not shown, engages a pressure plate, also not shown, that corresponds in construction and function to the pressure plate 46 of the embodiment of FIGS. 1–9. In any case, when the pressure in the pumping chamber 236 is less than the pressure in the inlet port 238, the flapper valve 242 will be biased upwardly to unseat from the adjacent structure of the chassis 216, which will permit ink to flow through the inlet port 238 into the pumping chamber 236, by gravity and/or by pressure. When the pressure in the pumping chamber 236 is greater than the pressure in the inlet port 238, however, which will be the case during a pumping cycle of an ink-jet containment and dispensing device that incorporates the flapper valve 242, the flapper 242 will be biased downwardly to seat against the opening of the inlet port 238 into the pumping chamber 236, thereby blocking the reverse flow of ink from the pumping chamber 236 into the inlet port 238. As is clear from FIG. 12 of the drawing, the pump spring 248 is axially offset with respect to the inlet port 238. Thus, the flapper valve 242 preferably should have some inherent spring-like qualities, and the seating of the flapper valve 242 against the opening from the inlet port 238 into the pumping chamber 236 is preferably augmented by requiring that the free end of the flapper valve 242, that is, the end that seats against the opening from the inlet port 238 into the pumping chamber 236, be flexed upwardly, as shown in FIG. 12.

In the embodiment of FIG. 13, elements that correspond to the elements of the embodiment of FIGS. 1–9 are identified by a 300 series numeral, the last two digits of which correspond to the last two digits of the corresponding element of the embodiment of FIGS. 1–9.

A molded plastic chassis 316 incorporates an inlet port 338 to permit ink to flow into a pumping chamber 336, which is circumscribed by a perimetrical wall, not shown, that corresponds to the perimetrical wall 37 of the embodiment of FIGS. 1–9. The chassis 316 incorporates an annular, frustoconical seat 316*a* within the inlet port 338, and one-way flow of ink through the inlet port 338 into the pumping chamber 336 is provided by a floating check ball 342, that seats against the seat 316*a* in the flow blocking position of the ball 342. The ball 342 is normally urged against the seat 316*a* by a sealing spring 342*a*, an end of which bears against the ball 342 and an opposed end of which is retained by an end of a pump spring 348. In that regard, the illustrated end of the pump spring 348 is received on a spike 350, which is formed integrally with the chassis 316, the opposed end of the pump spring 348, not shown, engaging a pressure plate, also not shown, that corresponds in construction and function to the pressure plate 46 of the embodiment of FIGS. 1–9.

In the embodiment of FIG. 14, elements that correspond to the elements of the embodiment of FIGS. 1–9 are identified by a 400 series numeral, the last two digits of which correspond to the last two digits of the corresponding element of the embodiment of FIGS. 1–9.

An ink-jet containment and dispensing device according to the embodiment of FIG. 14 has a molded plastic chassis 416 with an inlet port 438 therein, the chassis 416 having an annular, frustoconical seat 416*a* in the inlet port 438. Flow of ink through the inlet port 438 into a pumping chamber 436, which is circumscribed by a perimetrical wall, not shown, that corresponds to the perimetrical wall 37 of the embodiment of FIGS. 1–9, is selectively permitted or prevented by a free-floating check ball 442 positioned within the inlet port 438 and adapted to block flow through the inlet port 438 when the ball 442 engages the seat 416*a*. The ball 442 is free to travel within the inlet port 438, within limits, which are defined by the seat 416*a* and a pump spring 448, the illustrated end of which limits the travel of the ball 442 away from the seat 416*a*. The pump spring 448, which is securely positioned with respect to the ball 442 by a spike 450, which is formed integrally with the chassis 416, has an opposed end, not shown, which engages a pressure plate, also not shown, that corresponds in construction and function to the pressure plate 46 of the embodiment of FIGS. 1–9. The ball 442, thus, is not positively mechanically urged against the seat 416*a*, as in the manner of the ball 342 of the embodiment of FIG. 13, which is positively mechanically urged against the seat 316*a* by the spring 342*a*. However, a higher pressure within the pumping chamber 436 and the pressure within the inlet port 438 will hydraulically urge the ball 442 against the seat 416*a*, to thereby block the reverse flow of ink from the pumping chamber 436 back through the inlet port 438 during a pumping cycle of the embodiment of the invention illustrated in FIG. 14.

In the embodiment of FIG. 15, elements that correspond to the elements of the embodiment of FIGS. 1–9 are identified by a 500 series numeral, the last two digits of which correspond to the last two digits of the corresponding element of the embodiment of FIGS. 1–9.

The embodiment of FIG. 15 is a variation of the embodiment of FIG. 14, and the variation lies in the configuration of a portion of the inlet port 538 that is downstream of an annular, frustoconical seat portion 516*a* in a molded plastic chassis 516, such downstream portion being identified by reference numeral 538*a*. The downstream portion 538*a* of the inlet port 538 is provided with a plurality of circumferentially spaced apart and longitudinally extending ribs 538*b* to guide the travel of the ball 542 as it lifts off the seat 516*a* under the influence of a higher pressure in an upstream portion of the inlet port 538 than in the downstream portion 538*a*, which leads into a pumping chamber 536 that is defined by a perimetrical wall, not shown, that which corresponds to the perimetrical wall 37 of the embodiment of FIGS. 1–9. Because of the presence of the ribs 538*b*, the cross-sectional area of the downstream portion 538*a* of the inlet port 538 is larger than the corresponding portion of the inlet port 438 of the embodiment of FIG. 14, thus increasing the rate of ink flow through the inlet port 538 for a small distance of liftoff of the ball 542 from the seat 516*a*. Further, the ball 542 will seat against the seat 516*a* more quickly when the chamber 536 is pressurized because of the greater area of the downstream portion 538*a* of the inlet port 538. In any case, the travel of the ball 542 within the inlet port 538 is limited by the presence of a pump spring 548, which is similar to the pump spring 448 of the embodiment of FIG. 14 and is retained by a spike 550 that is formed integrally with the chassis 516, in the manner that the pump spring 448 of the embodiment of FIG. 14 is held in place by the spike 450.

Figure 16:
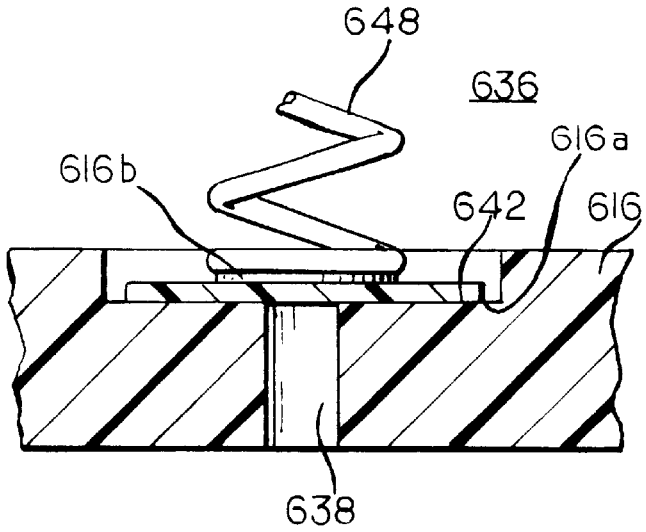

In the embodiment of FIG. 16, elements that correspond to the elements of the embodiment of FIGS. 1–9 are identified by a 600 series numeral, the last two digits of which correspond to the last two digits of the corresponding element of the embodiment of FIGS. 1–9.

The embodiment of FIG. 16 may be considered to be a variation of the embodiment of FIGS. 10 and 11. In that regard, in the embodiment of FIG. 16, a molded plastic chassis 616 has an inlet port 638 for permitting ink to flow therethrough into a pumping chamber 636, which is defined by a perimetrical wall, not shown, that corresponds to the perimetrical wall 37 of the embodiment shown in FIGS. 1–9. One-way flow of ink through the inlet port 638 into the pumping chamber 636 is ensured by a flat valve 642, which seats against an annular seat 616*a* of the chassis 616 when pressure in the pumping chamber 636 is higher than pressure in the inlet port 638, for example, during a pumping cycle of the ink containment and dispensing device that incorporates chassis 616. While a pump spring 648 is provided in alignment with the inlet port 638, the chassis 616 is provided with ribs 616*b* that limit the contact between the pump spring 648 and the flat valve 642 to contact after the flat valve 642 has lifted from the seat 616*a* by a predetermined distance. The axial extent of the ribs 616*b* can be varied to provide for an adjustable float of the flat valve 642, as required to optimize its response time to changes in the pressure difference between the pressure in the inlet port 638 and the pressure in the pumping chamber 636.

Figure 17:
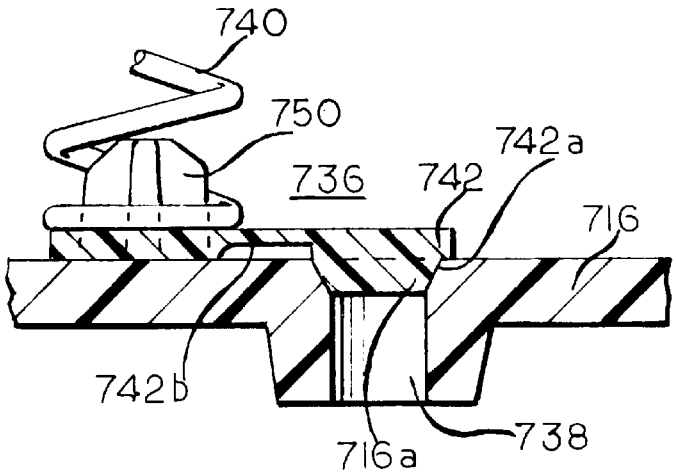

In the embodiment of FIG. 17, elements that correspond to the elements of the embodiment of FIGS. 1–9 are identified by a 700 series numeral, the last two digits of which correspond to the last two digits of the corresponding element of the embodiment of FIGS. 1–9.

In the embodiment of FIG. 17, one-way flow of ink through an inlet 738 of a molded plastic chassis 716 into a pumping chamber 736, which is defined by a perimetrical wall, not shown, that corresponds to the perimetrical wall 37 of the embodiment of FIGS. 1–9, is ensured by a molded plastic, flexible member 742. The member 742 has an annular, frustoconical surface 742*a* that engages an annular, frustoconical seat 716*a* of the chassis 716 when pressure in the pumping chamber 736 is higher than pressure in the inlet port 738, for example, during a pumping cycle of the ink containment and dispensing device that incorporates chassis 716. However, when pressure in the inlet port 738 is greater than pressure in the pumping chamber 736, the member 742 can flex into the pumping chamber 736, to lift its surface 742*a* from the surface 716*a* and thereby permit ink to flow into the pumping chamber 736. The member 742 is positively positioned with respect to the chassis 716 by inserting it over a spike 750, which is formed integrally with the chassis 716, and by resiliently biasing the member 742 against the chassis 716 by a pump spring 748, which is also retained on the spike 750. The member 742 has an undercut portion 742*b*, which serves as a hinge for the flexing of the member 742 into and out of the pumping chamber 736, and the thickness and width of the undercut portion 742*b* can be adjusted to optimize the spring rate at which the member 742 seats and unseats due to changes in the pressure difference between the pumping chamber 736 and the inlet port 738.

Figure 18:
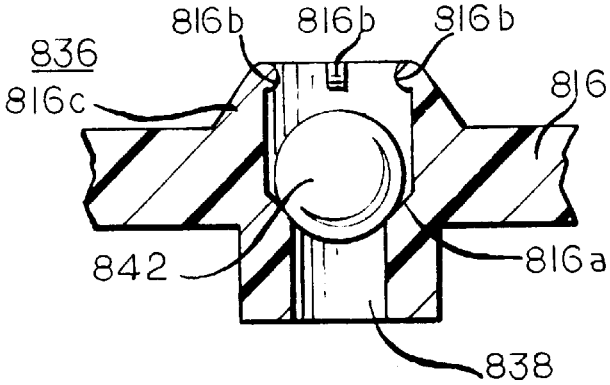

In the embodiment of FIG. 18, elements that correspond to the elements of the embodiment of FIGS. 1–9 are identified by an 800 series numeral, the last two digits of which correspond to the last two digits of the corresponding element of the embodiment of FIGS. 1–9.

In the embodiment of FIG. 18, a ball 842 is positioned within an inlet port 838 of a molded plastic chassis 816 to limit the flow of ink through the inlet port 838 to flow into a pumping chamber 836, which is defined by a perimetrical wall, not shown, that corresponds to the perimetrical wall 37 of the embodiment of FIGS. 1–9. The chassis 816 has an annular, frustoconical surface 816a against which the ball 842 seats when the pressure in the chamber 836 is higher than the pressure in the inlet port 838 to prevent flow from the pumping chamber 836 back through the inlet port 838. When the pressure in the inlet port 838 is higher than the pressure in the pumping chamber 836, the ball 842 will unseat from the surface 816*a*, to permit the flow of ink from the inlet port 838 into the pumping chamber 836.

The movement of the ball 842 within the inlet port 838 is limited by a circumferentially spaced-apart series of inwardly projecting tabs 816*b* of the chassis 816, the ball 842 being insertable into the inlet port 838 by a pressed fit. The tabs 816*b* of the chassis 816 are formed in an upstanding, annular, frustoconical portion 816*c* of the chassis 816. Because of the frustoconical configuration of the portion 816*c* of the chassis 816, the outer surface of the portion 816*c* has a taper that facilitates the stripping of the chassis 816 from the mold and core used in the molding of the chassis 816.

The liquid containment and dispensing device of the various embodiments of the present invention has been specifically described as a device for containing and dispensing a supply of printing ink in an ink-jet printer as the preferred embodiment of the invention. However, it is also contemplated that the present invention can easily be adapted to the containment and dispensing of other Newtonian (low viscosity) liquids.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims and the legal equivalents thereof.

What is claimed:

1. In a containment and dispensing device for a liquid, said containment and dispensing device having a rigid, generally cup-shaped outer shell with an open end, a molded plastic chassis secured to the open end of the shell, the chassis having a pumping mechanism with an outlet for the liquid therefrom, a flexible pouch having an open end the open end being in liquid communication with the pumping mechanism, a check valve separating the flexible pouch from the pumping mechanism for permitting the liquid to flow from the flexible pouch into the pumping mechanism while preventing the liquid from flowing from the pumping mechanism into the flexible pouch to dispense the liquid from the pumping mechanism through the liquid outlet, characterized in that no portion of the check valve is heat-staked to the chassis.

2. A liquid containment and dispensing device, according to claim 1 wherein the check valve has a form of a planar member formed from a flexible material with spring-like qualities.

3. A liquid containment and dispensing device according to claim 2 wherein said planar member has a portion that overlies an opening in said chassis.

4. A liquid containment and dispensing device according to claim 3 and further comprising: spring means for biasing a second portion of said planar member against said chassis.

5. A liquid containment and dispensing device according to claim 4 wherein said spring means bears said planar member in alignment with said opening in said chassis.

6. A liquid containment and dispensing device according to claim 4 wherein said spring member bears against said planar member out of alignment with said opening.

7. A liquid containment and dispensing device according to claim 1 wherein said check valve is in the form of a ball that seats against an annular seat surrounding an inlet opening in the chassis that leads to said pumping mechanism.

8. A liquid containment and dispensing device according to claim 7 and further comprising: spring means resiliently biasing said ball into engagement with said annular seat.

9. A liquid containment and dispensing device according to claim 1 wherein said check valve is a flexible molded plastic member, said molded plastic member having a portion with an annular frustoconical surface that engages a mating annular frustoconical surface of said chassis when said molded plastic member is positioned to block flow of ink from the pumping mechanism to the flexible pouch; and further comprising:

spring means engaging said molded plastic member at a second location away from a location of the mating annular frustoconical surface of said molded plastic member and resiliently biasing said molded plastic member into engagement with said chassis.

10. A method of providing for one-way flow of liquid from a pouch through a pumping mechanism of a chassis of a liquid containment and dispensing device, the chassis having an inlet port in liquid communication with the pouch and the pumping mechanism, said method comprising:

providing a planar valve member within the chassis in alignment with the inlet port to block flow from the pumping mechanism to the pouch when pressure in the pumping mechanism is higher than pressure within the pouch, no portion of the planar valve being heat-staked to the chassis.

* * * * *